United States Patent [19]

Fujita

[11] Patent Number: 4,666,279

[45] Date of Patent: May 19, 1987

[54] CONVEYANCE APPARATUS FOR A STRIP OF PHOTOSENSITIVE MATERIAL

[75] Inventor: Nobuya Fujita, Wakayama, Japan

[73] Assignee: Noritsu Kenkyu Center Co., Ltd., Wakayami, Japan

[21] Appl. No.: 791,150

[22] Filed: Oct. 24, 1985

[30] Foreign Application Priority Data

Oct. 31, 1984 [JP] Japan ..... 59-163841[U]

[51] Int. Cl.[4] ..... G03D 3/08

[52] U.S. Cl. ..... 354/320; 354/339; 226/199

[58] Field of Search ..... 354/316, 319, 320, 321, 354/322, 338, 339; 226/189, 196, 199

[56] References Cited

U.S. PATENT DOCUMENTS 4,295,728 10/1981 Nishimoto ..... 226/196
4,316,664 2/1982 Nishimoto ..... 354/321
4,416,529 11/1983 Kastl ..... 226/189

FOREIGN PATENT DOCUMENTS 55-103553 8/1980 Japan ..... 354/322

*Primary Examiner*—A. A. Mathews

*Attorney, Agent, or Firm*—Larson and Taylor

[57] ABSTRACT

An improved conveyance apparatus for a variety of long photosensitive material in the form of printing paper having different size in width and length is disclosed. The apparatus includes a plurality of conveyance sections arranged one above another in the space as defined between the oppositely located side plates in the spaced relation as seen in the vertical direction, stationary elongated guide members extending between the adjacent conveyance sections in parallel with the direction of conveyance of printing paper and oppositely located V-shaped movable guide members into which both the side edges of printing paper are fitted. A distance between both the side plates is determined in dependence on the width of the widest printing paper to be treated and a distance between the adjacent conveyance sections as seen in the vertical direction is determined shorter than the length of the shortest printing paper. Further, a distance between the right-hand V-shaped movable guide members and the left-hand V-shaped movable guide members which are located opposite to one another can be changed as required by actuating a distance adjusting mechanism.

7 Claims, 11 Drawing Figures

CONVEYANCE APPARATUS FOR A STRIP OF PHOTOSENSITIVE MATERIAL

BACKGROUND OF THE INVENTION

1. Field of the Invention

The present invention relates to a conveyance apparatus usable for a strip of photosensitive material and more particularly to improvement of or relating to a conveyance apparatus incorporated in a photographic treating equipment or machine in which a series of processes such as developing, drying or the like are carried out for a strip of photosensitive material in the form of photographic printing paper.

2. Description of the Prior Art

As is seen with the conventional automatic developing equipment or machine, the hitherto known conveyance apparatus of the above-mentioned type usable for a strip of photographic printing paper (hereinafter referred to simply as printing paper) is generally constructed such that the existing rack having a specific conveyance apparatus employed therefor is replaced with another one every time when the size of printing paper to be treated changes. Specifically, in the case of the conventional automatic developing equipment or machine a plurality of racks each of which includes a specific conveyance apparatus designed for one of plural sizes to be used are provided previously and one of them is selectively incorporated in the equipment or machine when the size of printing paper is to be changed. This is intended to avoid the economical disadvantage due to previous provision of a specific equipment or machine for each of sizes of printing paper.

Obviously, replacement of the existing rack designed for a certain size of printing paper with another one designed for another size of printing paper is not only a time-consuming troublesome operation but also has many drawbacks in respect of operational efficiency, economy and convenience. For these reasons many requirements for a more effective and economical rack including a special conveyance apparatus employed therefor have been raised from the photographic treating industry. It is no exaggeration to say that these requirements have been increased to a peak at present, because development of photographic equipments or machines is accelerated in proportion to the latest enlargement of the application field of the information industry.

SUMMARY OF THE INVENTION

Thus, the present invention has been made with the foregoing background in mind.

It is a main object of the present invention to provide a conveyance apparatus usable for a variety of long photosensitive materials having different dimension in width and length which assures that it can be conveyed in the stable state merely by using a single rack without any necessity for replacing the existing rack with another one every time when width or length of the photosensitive material varies as is often found with the conventional conveyance apparatus which is generally used in various photographic treating equipment, drier or the like.

It is other object of the present invention to provide a conveyance apparatus usable for a variety of long photosensitive materials having different dimention in width and length which assures that it can be operated in an effective manner at an inexpensive cost.

It is another object of the present invention to provide a convenyance appartus usable for a variety of long photosensitive material having different dimensions in width and length which assures that the distance between oppositely located movable guide members into which both the side edges of the photosensitive material are fitted can be adjusted as required without any necessity for directly touching the guide members with fingers of an operator by actuating a distance adjusting mechanism which is located remote from the guide members.

It is further another object of the present invention to provide a conveyance apparatus usable for a variety of long photosensitive materials haveing different dimensions in width and length which assures that it can be conveyed in the stable manner with the aid of stationary elongated guide members having a bow-shaped configuration in the longitudinal cross-section, wherein conveyance of the paper is achieved while it is slightly bent in the arched cross-sectional shape as seen at a right angle relative to the direction of conveyance of the photosensitive material.

It is still another object of the present invention to provide a conveyance apparatus usable for long photosensitive material having different dimentions in width and length which is simple in structure and can be easily operated without any particular training.

To accomplish the above objects there is proposed according to the present invention an improved conveyance apparatus usable for a variety of long photosensitive material adapted to be treated in photographic treating equipment, drier or the like, wherein the improvement comprises a plurality of conveyance sections arranged one above another in the spaced relation in the space as defined between the side plates, a distance between the adjacent conveyance sections being determined shorter than the length of the shortest photosensitive material and a distance between both the side plates being determined wider than the width of the widest photosensitive material, a plurality of movable guide members into which both the side edges of the photosensitive material are fitted during conveyance of the latter, a distance between the oppositely located movable guide members being adjusted in dependence on the width of the photosensitive material to be treated by actuating a distance adjusting mechanism, and a plurality of stationary guide members adapted to bend the photosensitive material in the arched cross-sectional shape as seen in the plane at a right angle relative to the direction of conveyance of the photosensitive material while they come in contact with the base surface of the photosensitive material at the substantially middle part thereof.

Other objects, features and advantages of the invention will become readily apparent from reading of the following description which has been prepared in conjunction with the accompanying drawings.

BRIEF DESCRIPTION OF THE DRAWINGS

The accompanying drawings schematically illusstrate a conveyance apparatus in accordance with a preferred embodiment of the invention which is considered as the best mode for employing the apparatus for a rack for an automatic developing equipment in which a series of treatments such as developing or the like are carried out for a strip of photosensitive material which has been exposed to light beam in the printer. It should be noted that insignificant parts or components constituting the apparatus which are well known by any expert in the art are not illustrated and described in the specification for the purpose of simplification.

FIG. 9(*b*) is a front view of a knob for transmitting rotational force to the boss in FIG. 9(*a*), shown in the disassembled state, and FIG. 9(*c*) is a bottom view of the knob in FIG. 9(*b*).

It should be noted that same or similar parts or components shown throughout the drawings are identified by same reference numerals.

DESCRIPTION OF THE PREFERRED EMBODIMENT

Now, the present invention will be described in a greater detail hereunder with reference to the accompanying drawings which schematically illustrate a conveyance apparatus for a strip of photosensitive material in accordance with a preferred embodiment of the invention.

Figure 1:
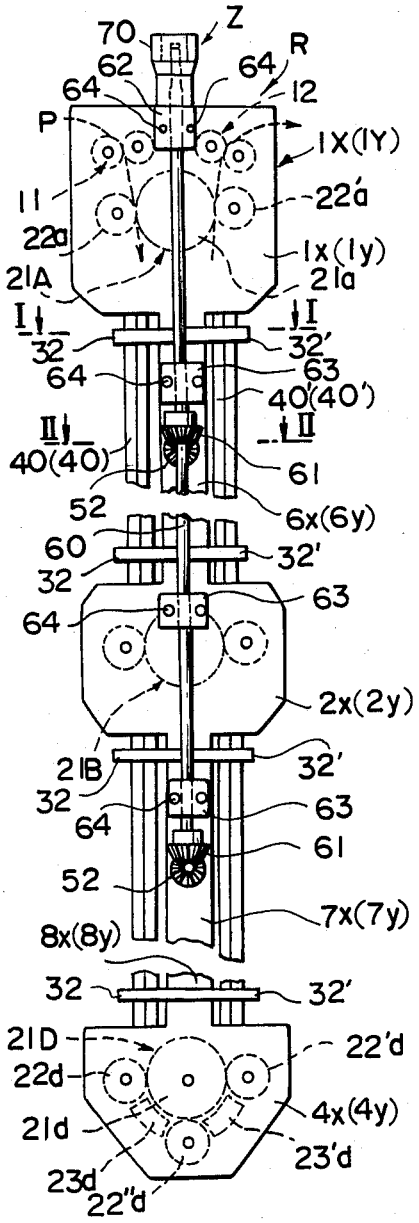
FIG. 1 is a schematic front view of the apparatus as seen in the direction at a parallel angle relative to the surface of printing paper, shown in the shortened state in the vertical direction.

First, refering to FIG. 1, reference letter R designates a rack and reference letter P designates various kinds of printing paper having different width and length adapted to be conveyed by means of the rack R which is immersed in each of treating bathes in an automatic developing equipment which is not shown in the drawings. In the drawings reference numerals 1X and 1Y designate a side plate that is usually called rack plate respectively. The side plates 1X and 1Y having substantially the same shape and dimensions are located opposite to one another at a predetermined distance kept therebetween which is determined appreciably wider than the width of the widest printing paper. As is apparent from FIGS. 1 to 4, the side plates 1X and 1Y include plate-shaped portions 1*x* and 1*y*, plate-shaped portions 2*x* and 2*y*, plate-shaped portions 3*x* and 3*y* and U-shaped bent plate portions 6*x* and 6*y*, 7*x* and 7*y*—8*x* and 8*y*. Specifically, the plate-shaped portions 1*x* and 1*y* are formed with a plurality of bearing fitting holes 11*x*, 11*y*, 12*x*, 12*y*, 21*x*, 21*y* and others for a group of rollers 21A including take-in rollers 11 and take-out rollers 12 each of which comprises a driving roller and a driven roller, a driving roller 21*a* disposed below the rollers 11 and 12 at the position located therebetween as seen in the vertical direction so as to carry out conveyance of printing paper P, the driving roller 21*a* having a diameter larger than that of the rollers 11 and 12, and driven rollers 22*a* and 22′*a* adapted to come in contact with the driving roller 21*a* at the position located below the rollers 11 and 12. The plate-shaped portions 2*x* and 2*y* are formed with bearing fitting holes 22*x* and 22*y* for a group of rollers 21B which are constructed in the same structure as the rollers 21A. The holes 22*x* and 22*y* are located below the holes 21*x* and 21*y* for the rollers 21A at a distance which is determined appreciably shorter than the length of the shortest printing paper P. The plate-shaped portion 3*x* and 3*y* (not shown) are formed with bearing fitting holes 23*x* and 23*y* for a group of rollers 21C (not shown) which are constructed in the same structure as the roller 21B. The holes 23*x* and 23*y* are located below the holes 22*x* and 22*y* in the same manner as mentioned above. The plate-shaped portions 4*x* and 4*y* are formed with bearing fitting holes 24*x* and 24*y* for a group of rollers 21D. The rollers 21D are located at the lowermost position and include a driving roller 21*d*, driven rollers 22*d* and 22′*d*, a driven roller 22″*d* and guide pieces 23*d* and 23′*d*. The driving roller 21*d* driven rollers 22*d* and 22′*d* are constructed in the same manner as the foregoing rollers 21A, 21B and 21C, while the driven roller 22″*d* and guide pieces 23*d* and 23′*d* are used for changing reversewisely the conveyance direction of printing paper. The U-shaped bent plates 6*x*, 6*y*, 7*x*, 7*y*—8*x* and 8*y* are firmly connected to the plate-shaped portions 1*x*, 1*y*, 2*x*, 2*y*—4*x* and 4*y* so that the latter are arranged one above another in the vertically aligned relation. Further, the U-shaped bent plates 6*x*, 6*y*, 7*x*, 7*y*—8*x* and 8*y* are formed with threaded holes 34*x* and 34*y* for fastening stationary guide members 30 and 30′ to be described later as well as screw shaft bearing fitting holes 53*x* and 53*y* for screw shafts which serve to change a distance between V-shaped movable guide members 40 and 40′ into which both the side edges of printing paper P are fitted.

Figure 2:
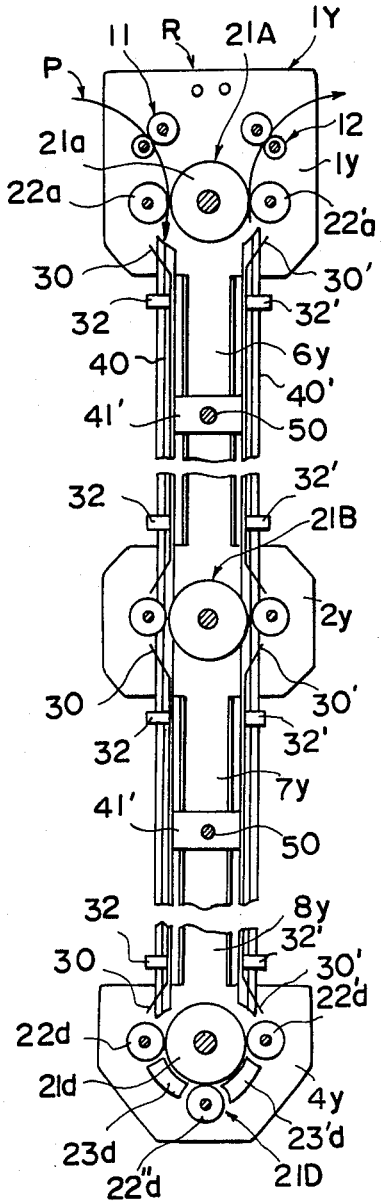
FIG. 2 is a schematic vertical sectional view of the apparatus taken along a plane vertically extending between the oppositely located side plates of the rack, shown in the shortened state in the vertical direction.
Figure 3:
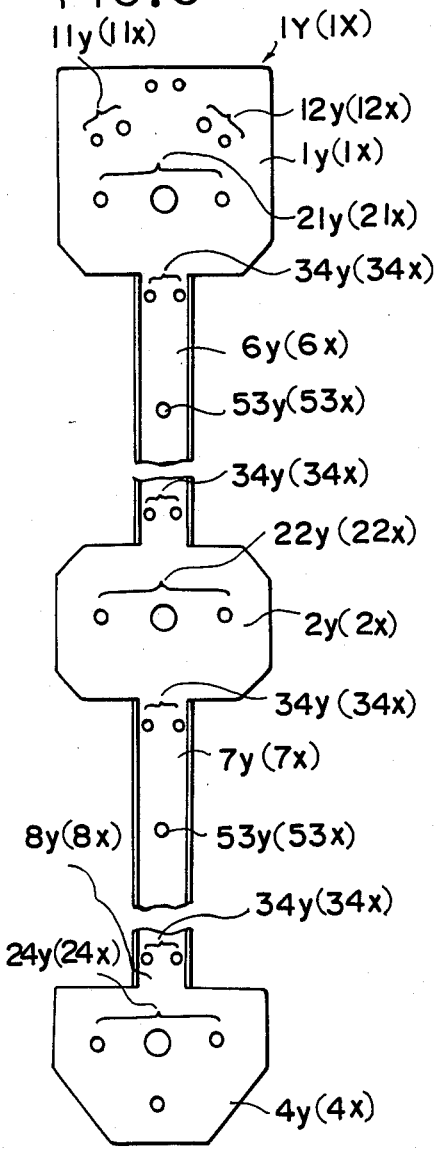
FIG. 3 is a front view of the rack plate as seen from the inside, shown in the shortened state in the vertical direction.
Figure 4:
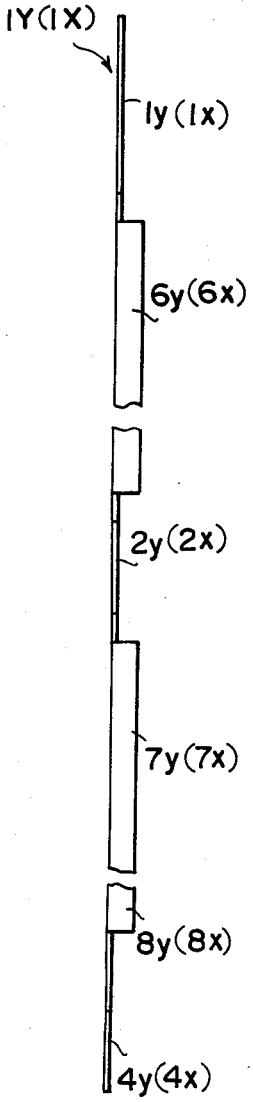
FIG. 4 is a side view of the rack plate in FIG. 3.
Figure 5:
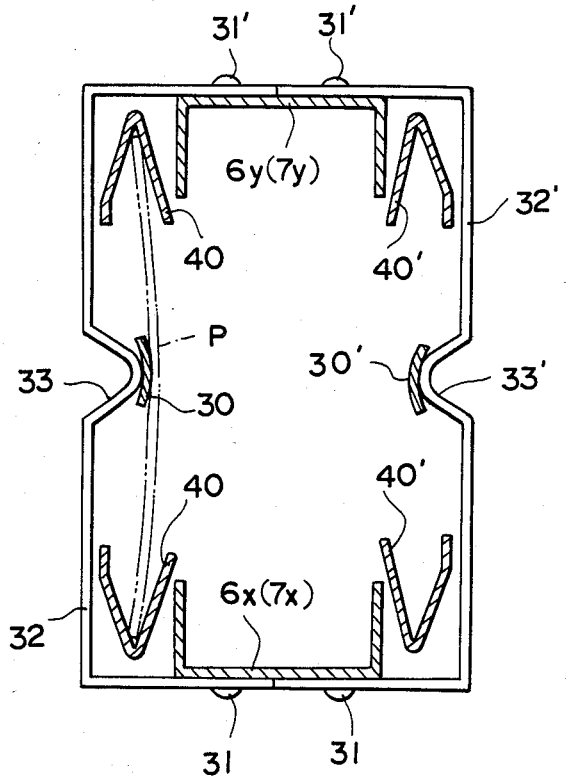
FIG. 5 is a schematic cross-sectional view of the apparatus taken in line I—I in FIG. 1, particularly illustrating how stationary elongated guide members adapted to guide conveyance of printing paper having different width in the vertical direction while its one surface comes in contact with the guide member are fixedly secured to the stationary guide member fastening member.

As shown in FIG. 2, the stationary guide members 30 and 30′ are fixedly disposed in the area located between the adjacent rollers among the conveyance rollers 21A, 21B and 21C and the conveyance direction changing roller 21D and each of them has the substantially same bow-shaped configuration as seen from the side. The stationary guide members 30 and 30′ are intended to guide the printing paper in contact with middle part of the base surface of printing paper P to curve it laterally under the effect of an appreciably small intensity of thrust force caused thereby in the area between the adjacent rollers among the rollers 21A to 21D while they come in contact with printing paper P. As shown in FIG. 5, the U-shaped bent plates 6*x* to 8*y* are fastened to the stationary guide member fastening members 32 and 32' by means of set screws 31 and 31' which are threadably engaged to threaded holes 34x and 34y formed at the position located in the vicinity of both the ends of the U-shaped bent plates 6x to 8y whereby the stationary guide members 30 and 30' are supported at the apex of the inwardly projected parts 33 and 33' of the stationary guide member fastening members 32 and 32' having the rectangular cross-sectional configuration.

Figure 6:
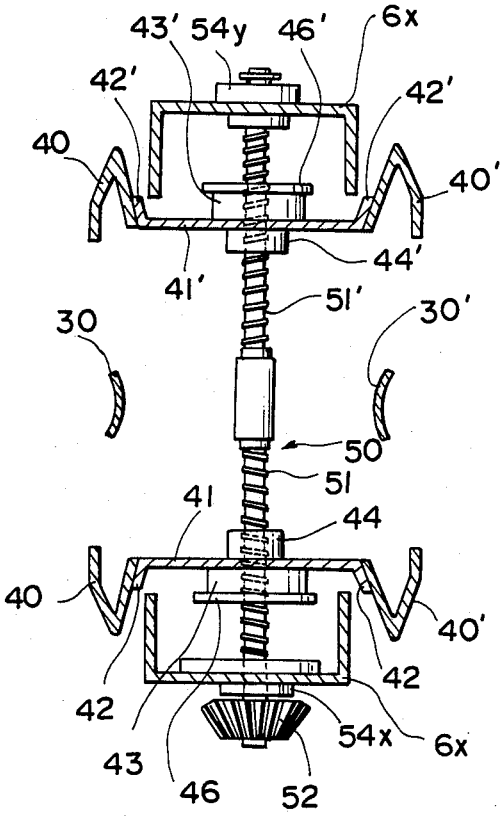
FIG. 6 is a schematic cross-sectional view of the apparatus taken in line II—II in FIG. 1, particularly illustrating how V-shaped movable guide members are located opposite to one another in the apparatus and moreover illustrating how a distance adjusting mechanism for adjusting a distance between the V-shaped movable guide members is constructed.

The V-shaped movable guide members 40 and 40' are as illustrated in detail in FIGS. 5 and 6. Specifically, they are located opposite to one another in the area as defined between the rollers 21A on the side of the takein roller 11 and the conveyance direction changing rollers 21D as well as between the latter and the rollers 21A on the side of the take-out roller 12 in such a manner that distance as measured therebetween can be changed as required. As is readily apparent from the drawings, each of them has a vertically extending V-shaped groove into which both the side edges of printing paper P are fitted. In order that the V-shaped movable guide members 40 and 40' are located opposite to one another, they are fixedly secured to side parts 42 and 42' of at least two securing plates 41 and 41' disposed at the upper and lower parts of the rack and the securing plates 41 and 41' are designed a little larger than the U-shaped bent plates 6x to 8y.

Figure 7:
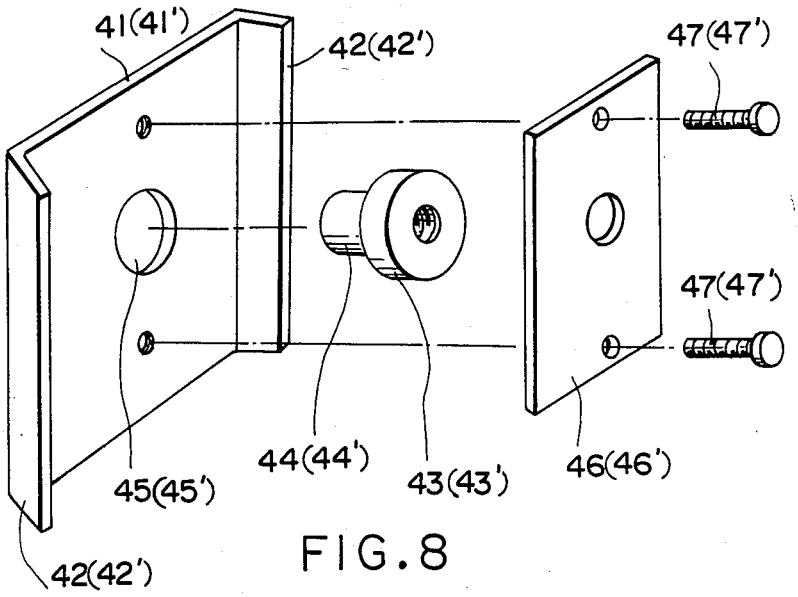
FIG. 7 is a perspective view illustrating how a movable guide member fastening member, a nut and a retaining plate are assembled together, shown in the disassembled state.
Figure 8:
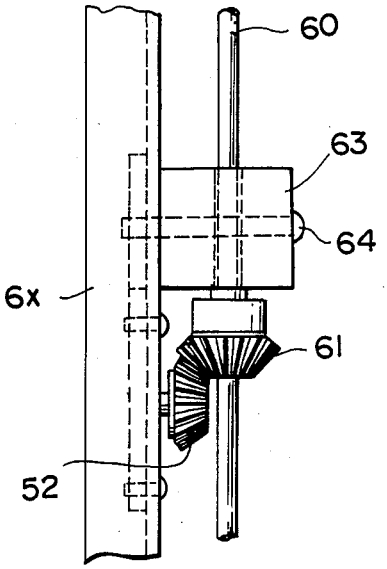
FIG. 8 is a fragmental side view of the distance adjusting mechanism, particularly illustrating how rotational force is transmitted to a screw shaft by way of bevel gears, shown in an enlarged scale.

The securing plates 41 and 41' are designed in the same configuration (see FIGS. 6 and 7) and they are formed at the central part with through hole 45 and 45' into which cylindrical portions 44 and 44' of nuts 43 and 43' are inserted. The nuts 43 and 43' constitute one member of a distance adjusting mechanism for adjusting a distance between respective opposing pair of the V-shaped movable guide members 40, 40 and 40', 40' as required and the female thread of the nut 43 is generated in the reverse direction to that of the nut 43'. After the nuts 43 and 43' are fitted into the holes 45 and 45', they are fixedly held by means of retaining plates 46 and 46' with the aid of tightening bolts 47 and 47' which are threadably engaged to the securing plates 41 and 41'.

In the drawings reference numeral 50 designates a screw shaft of which right part is machined to generate right-hand screw 51 and of which left part is machined to generate left-hand screw 51'. The nut 43 is threadably engaged to the right-hand screw 51 and the nut 43' is threadably engaged to the left-hand screw 51'. Both the end parts of the screw shaft 50 are rotatably supported by means of bearing 54x and 54y firmly fitted into holes 53x and 53y on the U-shaped bent plates 6x, 6y, 7x and 7y and the right end part of the same is projected outwardly of the U-shaped bent plates 6x and 7x so that a bevel gear 52 is fixedly mounted thereon. In the illustrated embodiment the bearings 54x and 54y for the screw shaft 50 are fitted to the U-shaped bent plates. However, the present invention should not be limited only to this. Alternatively, they may be fitted to other members rather than the U-shaped bent plates.

The rack is provided with a knob mechanism Z for the purpose of adjusting a distance between the V-shaped movable guide members as will be described in more details later. Specifically, the knob mechanism Z includes a rotational shaft 60 adapted to rotate in both the directions on which bevel gears 61 are fixedly mounted. Each of the bevel gears 61 meshes with the bevel gear 52 on the screw shaft 50. As the rotational shaft 60 is rotated by actuating the knob mechanism Z, the screw shafts 50 are rotated in the normal direction or in the reverse direction whereby the secureing plates 41 and 41' are caused to move toward or away from one another by way of the right-hand and left-hand screws 51 and 51'. Thus, distance between the V-shaped movable guide members 40 and 40 and 40' and 40' is adjusted as required so as to smoothly guide movement of printing paper P having different size.

As is apparent from FIG. 1, the rotational shaft 60 is rotatably supported by means of a boss 62 fixedly secured to the plate-shaped portion 1x of the side plate 1a by means of set screws 64 and supporting members 63 fixedly secured to the U-shaped bent plates 6x and 7x by means of set screws 64 and the bevel gears 61 adapted to mesh with the bevel gears 52 are fixedly mounted on the rotational shaft 60.

Figure 9A:
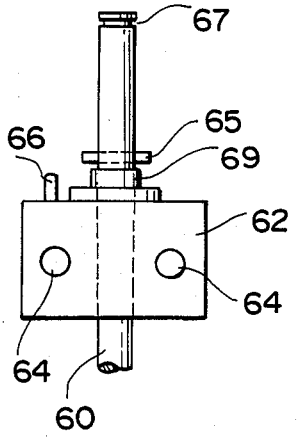
FIG. 9(*a*) is a front view of a boss disposed at the upper end part of a rotational shaft for the distance adjusting mechanism.
Figure 9B:
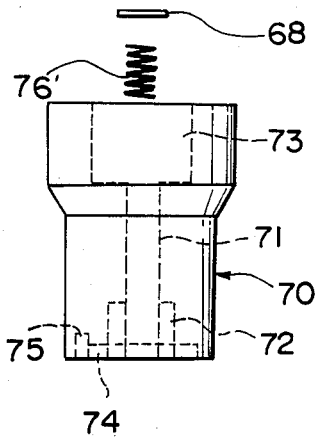
Figure 9C:
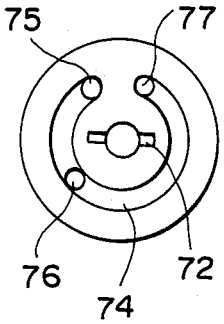

As shown in FIG. 1 and in FIGS. 9a, 9b and 9c more clearly, the knob mechanism Z includes a boss 62 fixedly mounted on the top of the plate-shaped portion 1x at the uppermost end of the side plate plate 1X at the position located between the take-in rollers 11 and the take-out rollers 12, a rotational shaft 60 rotationally supported by means of the boss 62 and a knob 70 adapted to be operatively engaged to the rotational shaft 60 to rotate together with the latter as essential components for the knob mechanism of the apparatus.

The boss 52 is formed with a hole through which the rotational shaft extends in the vertical direction and a pin 66 is erected thereupon.

Further, the knob 70 is formed with a hole 71 through which the rotational shaft 60 extends in the vertical direction and moreover it is formed with vertically extending grooves 72 into which a spring pin 65 that is fitted through the rotational shaft 60 in the transverse direction is adapted to insert so as to allow both the rotational shaft 60 and the knob 70 to rotate together.

The knob 70 has a recessed part 73 on the upper part and an annular groove 74 on the bottom thereof adapted to guide slidable movement of the pin 66 on the boss 62 in response to rotation of the knob 70. The annular groove 74 has a plurality of pin insert holes 75, 76 and 77 having a deep depth which are intended to determine the rotational position of the screw shaft 50 to selectively determine a distance between the V-shaped guide members 40 and 40 and 40' and 40' in dependence on size of printing paper P and determination of the rotational position is achieved by inserting the pin 66 of the boss 62 into one of the insert holes.

Incidentally, assembling of the knob mechanism Z is carried out by way of the steps of inserting the upper part of the rotational shaft 60 through the hole 71 of the knob 70 from the lower side of the boss 62, fitting the spring roll pin 65 fixedly mounted through the rotational shaft 60 into the grooves 72 of the knob 70, inserting the pin 66 of the boss 62 into one of the insert holes 75, 76 and 77 on the annular groove 74 to place the knob 70 on the boss 62, fitting a coil spring 76' onto a part of the rotational shaft 60 projected upwardly of the bottom of the recessed part 73 of the knob 70 and finally engaging an E-ring 68 to an annular groove 67 at the uppermost end of the rotational shaft 60 so as to allow the coil spring 76' to be accomodated in the space as defined between the E-ring 68 and the bottom of the recesses part 73. In the drawings reference numeral 69 designates a position retaining collar fixedly mounted on the rotational shaft 60.

Next, operation of the conveyance apparatus of the invention as constructed in the above-descrived manner will be described below.

The racks R having the apparatus of the invention are immersed in a treating liquid bath or the like and the adjacent racks joined to one another by way of a turn guide or the like with conventional conveyance rollers incorporated therein. To determine a distance between the V-shaped movable guide members 40 and 40 and 40' and 40' in conformance with the width of printing paper P to be treated, the knob 70 is then lifted up against resilient force of the coil spring 76' to rotate the rotational shaft 60. Rotation of the rotational shaft 60 is transmitted to the screw shaft 50 via the bevel gears 61 and 52 whereby the securing plates 41 and 41' are displaced together with the nuts 43 and 43' which serve as so-called turnbuckle until the V-shaped movable guide members 40 and 40' assume the required distance. After completion of adjustment of the distance between the V-shaped movable guide members 40 and 40' the knob 70 is lowered so as to allow the pin 66 to be inserted into one of the insert holes 75, 76 and 77 in dependence of the width of printing paper P, resulting in the rotational shaft 60 being inhibited from further rotation. Now, the apparatus is ready to be used.

Thereafter, each of the treating liquid bathes is supplied with treating liquid in the same manner as in the case of the conventional treating equipment and the rollers 11, 21A 21B—21D and 12 are then driven while treating liquid in the treating liquid baths is recirculated. As a result, printing paper P is conveyed toward the next station where required treatment is carried out, while both the side edges of printing paper P are guided by means of the V-shaped movable guide members 40 and 40'. At this moment the central part of printing paper P as seen in the longitudinal direction is bent to the arch-shaped contour in order to exhibit a high intensity of resistent force against warping while it is brought in contact with the stationary guide members 30 and 30'.

When new printing paper P having different width is to be conveyed later, adjustment of a distance between the V-shaped movable guide members 40 and 40 and 40' and 40' is achieved in the same manner as described above.

If it is necessary that adjustment of a distance between the V-shaped movable guide members 40 and 40 and 40' and 40' is carried out by rotating the rotational shaft within the extent of one revolution, it is recommendable that the right-hand and left-hand screws 51 and 51' are designed in the form of multiple thread screw. Further, the present invention should not be limited only to the side plates 1X and 1Y which are so called rack plate. Alternatively, side plate employed for other treating equipment, treating machine, drier or the like may be used.

As will be readily understood from the above-description, the early-mentioned objects of the invention has been successfully accomplished by means of the conveyance apparatus which makes it possible to convey a variety of long photosensitive materials having different dimensions in width and length in the stable state merely by using a single rack. Thus, it will be readily understood that it becomes possible to provide an improved conveyance apparatus usable for a variety of long photosensitive materials for which requirements have been raised from the associated industries.

While the present invention has been described above only with respect to a single preferred embodiment thereof, it should of course be understood that it should not be limited only to this but various changes or modifications may be made in any acceptable manner without departure from the spirit and scope of the invention. Obviously, the shown embodiment is merely illustrative but not limitative and the scope of the invention is as defined by the appended claims.

What is claimed is:

1. In a conveyance apparatus usable for a variety of long photosensitive material adapted to be treated in photographic treating equipment, the improvement comprising;

a plurality of conveyance sections arranged one above another in spaced relation in space as defined between two side plates, a plurality of movable guide members between which both of the side edges of the photosensitive material are fitted during conveyance of the latter, said movable guide members being movable along a rotatable screw shaft mounted on said side plates and having a right-hand male thread portion and a left-hand male thread portion engaged with female thread portions on said members so as to displace said guide members toward or away from one another to adjust the distance between the movable guide members by rotating said screw shaft, a plurality of stationary guide members mounted on said side plates and adapted to bend the photosensitive material in an arched cross-sectional shape as seen in the plane at a right angle relative to the direction of conveyance of photosensitve material while thay come in contact with the base surface of the photosensitive material at the substantially middle part thereof.

2. A conveyance apparatus as defined in claim 1, wherein each of the movable guide members which are located opposite to one another has a vertically extending V-shaped recess into which the one side edge of the photosensitive material is fitted so as to guide conveyance of the latter.

3. A conveyance apparatus as defined in claim 1, wherein each of the stationary guide members is designed in the form of bow-shaped elongated rod as seen from the side which extends between the adjacent conveyance sections.

4. A conveyance apparatus as defined in claim 1, wherein each of the stationary guide members comprises a series of rollers which are located in vertical alignment between the adjacent conveyance sections.

5. The invention of claim 1, wherein each of said sideplates is so designed in the plate-shaped configuration that the width increases at the upper end part, the lower end part and the intermediate position where each of the conveyance sections is located and each of said side plates has a U-shaped cross-sectional configuration to assure its rigidity in the area between the adjacent conveyance sections.

6. The invention of claim 1, wherein said screw shaft is adapted to rotate by a bevel gear being fixidly mounted on the one end of said screw shaft in conjunction with a distance adjusting mechanism which comprises a boss fixedly attached to the outside of one of said side plates, a rotational shaft rotatably supported by means of said boss, said rotational shaft having a bevel gear fixidly mounted thereon to mesh with the bevel gear on said screw shaft, and means attached to said rotational shaft to rotate latter.

7. The invention of claim 1, wherein said movable guide members are secured to securing plates which are located opposite to one another in parallel with the side plates, said securing plates including female thread portions in the form of a threaded nut through which said screw shaft is rotatably engaged.

* * * * *